United States Patent [19]

Bailey

[11] 4,088,066

[45] May 9, 1978

[54] DUST EXTRACTION APPARATUS FOR USE WITH PAPER AND LIKE MACHINERY

[75] Inventor: Victor Bailey, Alverstone, England

[73] Assignee: Bowater-Scott Corporation Limited, London, England

[21] Appl. No.: 716,219

[22] Filed: Aug. 20, 1976

[51] Int. Cl.[2] ..... F23J 11/00

[52] U.S. Cl. ..... 98/115 R; 139/1 C; 417/38;43

[58] Field of Search ..... 28/28; 139/1 C; 98/115 R; 160/201

[56] References Cited

U.S. PATENT DOCUMENTS

| | | | |
|---|---|---|---|
| 1,326,420 | 12/1919 | Pickens | 98/115 R |
| 1,389,155 | 8/1921 | Norris | 98/115 R |
| 1,920,870 | 8/1933 | Lancaster | 98/115 R |
| 2,861,836 | 11/1958 | Goeggel | 160/201 |
| 3,518,814 | 7/1970 | Maynard | 417/43 |

*Primary Examiner*—Ronald C. Capossela

*Attorney, Agent, or Firm*—Karl W. Flocks

[57] ABSTRACT

An apparatus for use with paper, tissue and like fibrous sheet material rewinding machinery, comprising a booth disposable substantially around the rewinding machinery and having side walls, an intake-end end wall a take-off end opening through which wound rewind bars may be withdrawn, a fixed cover over at least the take-off end, leaving an uncovered top portion at the intake end through which wound reels may be introduced and withdrawn, vent openings in the booth, a moveable cover portion moveable between an inoperative position clear of the intake opening and an operative position in which it forms a closure over the intake opening, means to move the moveable cover between the inoperative and operative positions, and means to induce flow of air from the atmosphere through the vent openings to minimise egress of dust from the booth without substantially distrubing the sheets as they are rewound.

6 Claims, 4 Drawing Figures

DUST EXTRACTION APPARATUS FOR USE WITH PAPER AND LIKE MACHINERY

BACKGROUND OF THE INVENTION

1. Field of the Invention

This invention relates to the paper making and like industries including the cellulose fibre tissue industry in which the fibrous materials are converted from pulp into dry thin sheets. In paper making, particularly in producing cellulose fibre tissues the sheets usually in continuous lengths are wound onto spindles known as shells to form reels of a substantial diameter, e.g. 5 feet, and length e.g. 11 feet. The sheets are then mounted in rewinding machines in which single plies of tissue from several reels are superposed and rewound as multiple sheets on spindles sometimes known as rewind bars. Such multiple ply tissue materials in sheet form are used in such products as paper toilet rolls, handkerchiefs, table napkins, hand towels, wadding for diapers and like articles and they have the advantage that they are completely disposable as, for example in the case of toilet paper, by flushing them down a water closet. The shells comprise hollow cylinders having at their ends spindles mounted through antifriction bearings in non-rotatable supports, adapted to be removably supported in fixed bearing blocks known as gab brackets fast with respect to machine frame.

2. Description of Prior Art

In known machines for processing such materials such as the rewinding machines, a substantial amount of dust mainly of cellulose fibre base from the sheets escapes into the ambient atmosphere which creates a substantial fire hazard and creates very unfavourable conditions for the operatives supervising and servicing the machinery.

Conventionally in such rewinding machines the dust is extracted from above the sheets as they are rewound by slotted ducts close to or in contact with the surface of the sheets and being at reduced pressure the duct suction orifices collect the dust and eject it to waste. Such dust extraction means are not satisfactory, in use, particularly in modern high speed machines, since only dust in the vicinity of the suction orifices is extracted and the ambient dust laden air becomes charged with dust creating a fire hazard and hampering the machine operators. If the dust is to be removed completely a large number of ducts must be employed which take up space in the rewinding area and means have to be provided to displace these ducts to enable the wound shells to be introduced into and the empty shells to be withdrawn from the rewinding machinery. Moreover, the suction necessary at the slotted ducts to maintain the rewinding machinery substantially free of dust is of such an order that turbulence in the ambient air can cause disruption or distortion of the tissue being rewound which is moving at a high speed, e.g. 3000 to 4000 feet per minute.

In tissue rewinding machines the full shells are lowered by lifting tackle into the gab brackets in the machine frame necessitating an open topped or uninterrupted space above the machine for insertion of loaded shells and removal of empty shells. The rewound tissues are removed on their rewind bars at the take-off end of the machine by rolling them horizontally to receiving tables or like means whence they are removed for sale or to other machinery for further processing. Such machinery necessitates the retraction of some of the slotted dust extractor ducts prior to removal of empty shells and the introduction of loaded shells and the remounting of the ducts prior to rewinding creating delays which with modern high speed machinery cannot be accepted as well as increasing the initial cost and maintenance cost of the machinery. It is moreover desirable with wide loaded shells e.g. 11 feet long, to provide means for slitting the tissue ribbons longitudinally into narrower ribbons or bands as they are transferred from the shells to the rewind bars and this constitutes an area of substantial dust generation in and around the rewind machinery.

The main object of the present invention is to provide a rewind apparatus for use in rewinding paper tissue and like fibrous sheet material in which the aforesaid disadvantages are reduced or substantially eliminated.

SUMMARY

According to the present invention an apparatus for use with paper, tissue and like fibrous sheet material rewinding machinery comprises a booth disposable substantially around the rewinding machinery and having side walls, an intake-end wall, a take-off end opening through which wound rewind bars may be withdrawn, a fixed cover over at least the take-off end, leaving an uncovered top portion at the intake end through which wound reels may be introduced and withdrawn, vent openings in the booth, a moveable cover portion moveable between an inoperative position clear of the intake opening and an operative position in which it forms a closure over the intake opening, means to move the movable cover between the inoperative and operative positions, and means to induce flow of air from the atmosphere through the vent openings to minimise egress of dust from the booth without substantially disturbing the sheets as they are rewound.

The moveable cover preferably comprises a panel riding along guides longitudinally of the machinery to close the reel intake opening in the operative position. The panel may have an end portion articulated thereto to close or substantially close the intake opening which may be lower at the intake end than the panel.

Ducts are preferably disposed at one side of the booth with intake apertures above the level of and/or beneath the moving sheet, and operable to induce the flow of air through the booth vent openings.

The means for moving the moveable cover to and from the operative position preferably comprises guides along the upper portion of the sides of the booth, guidable members moveable along the guides, and traction means moveable in opposite directions of the guide by power operated means such as a power driven winch or winches for moving the cover portion between the operative and inoperative positions.

DESCRIPTION OF PROPOSED EMBODIMENTS

Figure 1:
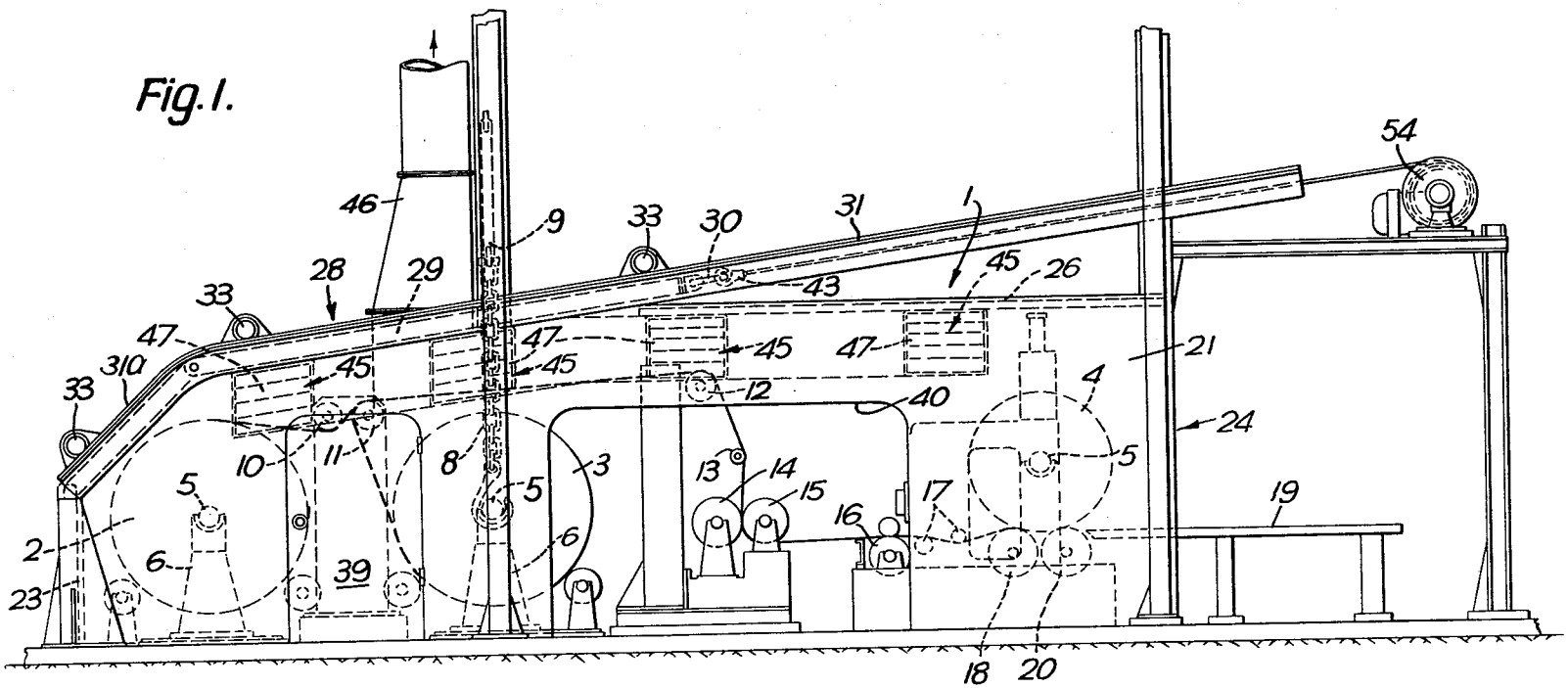
FIG. 1 is a side elevation showing the general lay out of a tissue rewinding machine of the invention with a dust extraction booth located round it.

In the drawings the same references are used to designate the same or similar parts.

Figure 2:
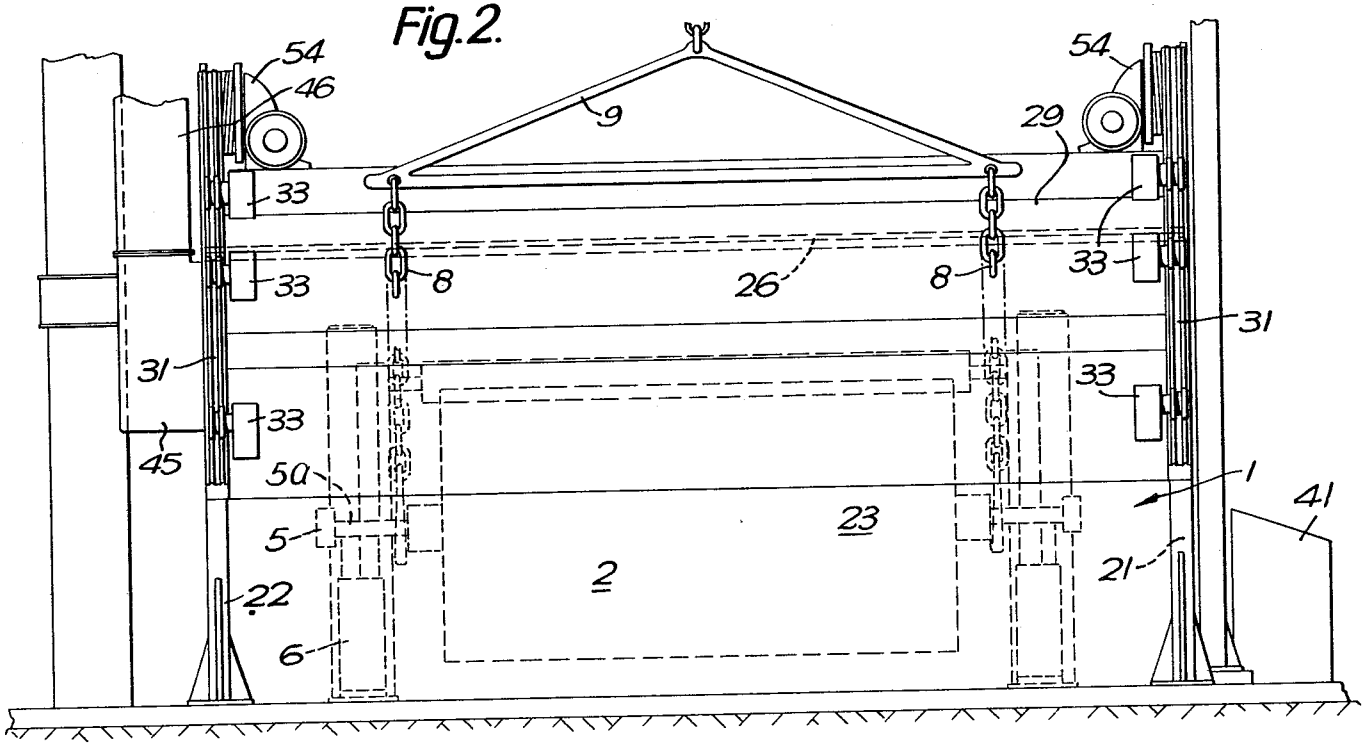
FIG. 2 is an end elevation looking from the left of FIG. 1 with the intake end wall omitted.
Figure 3:
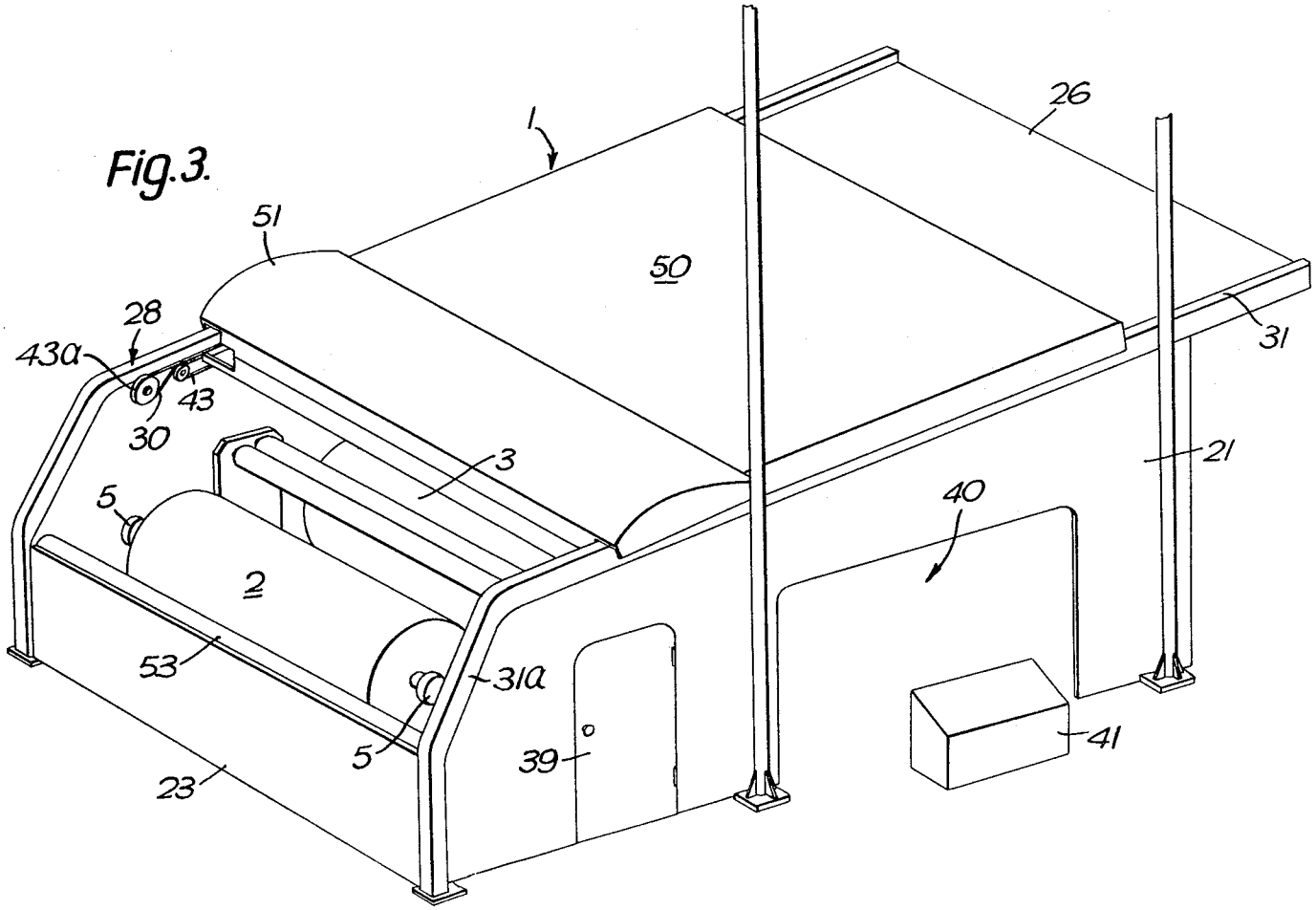
FIG. 3 is a diagrammatic perspective view of the machine and booth of FIGS. 1 and 2.

Referring to FIGS. 1 to 3 these show an apparatus for use with paper, tissue and like fibrous sheet material rewinding machines which basically comprises a booth disposable substantially around the machinery with means for maintaining the ambient air substantially free of dust emanating from the rewinding.

The machinery shown is by way of example and is a tissue web or sheet rewinding machine. The purpose of the rewinding is to transfer two wound tissue continuous sheets from reels on shells and to superpose them as they are wound on a rewind bar and/or to slit the sheets longitudinally as they are rewound.

The reels 2 and 3 are built on shells 5 and these are supported by their fixed elements 5*a* on gab brackets 6 for unwinding from the reels 2 and 3 and winding onto a rewind bar 4. The reels 2 and 3 are lowered onto their gab brackets by lifting means 8 shown as chains supported by a lifting mechanism 9 which forms no part of the present invention. The loading is facilitated by the front wall 23 of the booth being lower than the top of the booth since the loaded reels can then be loaded onto the gab brackets by a substantially horizontal movement. The bar 4 is removed by rolling it in a horizontal direction to the right in FIG. 1 onto a table 19 whence it is removed for other purposes, but it may be rewound by any known means.

The tissue wound on reel 2 and the tissue wound on reel 3 is drawn off over respectively the rollers 10, 11, 12, 13 to combining calendar rolls 14, 15 and thence over slitting rolls 16, 17 to the winding drums 18, 20 on which the reel 4 is wound on the bar 5.

The tissue being rewound in this mechanism and the mechanism itself forms no part of the present invention, is dry and liable to give off paper tissue fibrous dust particularly during slitting which collects in the ambient atmosphere causing a fire hazard and forms undesirable working conditions for the operatives working the machinery.

The booth 1 comprises side walls 21, 22 an intake end wall 23 and at the take-off end an opening 24 through which the wound bar 4 may be withdrawn in a horizontal direction onto the table. The side walls have a fixed cover 26 over the take-off end of the booth and it is connected to framing round the aperture for the take-off to keep to a minimum the open areas at that end of the machine. The other end of the fixed cover stops short of the reel 3 thereby leaving at that end of the machine, the top open in normal circumstances of loading and unloading the loaded reels and empty shells.

The uncovered portion 28 at the intake end is provided with a moveable cover portion formed of two parts articulated together, the first part 50 being a solid cover and the second part 51 having a curved shape which in the closed position will follow the contour of guides 31*a* at the intake end of the machine. When the cover is retracted to open the intake top end of the booth, the portion 51 articulates with respect to the portion 50 and rides along the guides. This cover portion is moveable by traction means 30 to slide along the guides 31*a*, 31 to cover or uncover this open end of the machine.

The moveable cover 50, 51 may have roller 33 which roll in or on the guides and such rollers are provided at varying points of their length, three in fact being shown in FIG. 1. These are also seen in elevation in FIG. 2. However, the portion of the cover engaging the guides may merely have sliding members with anti-friction devices such as anti-friction roller bearings, or ball bearings which ride in channel shaped guides.

Figure 4:
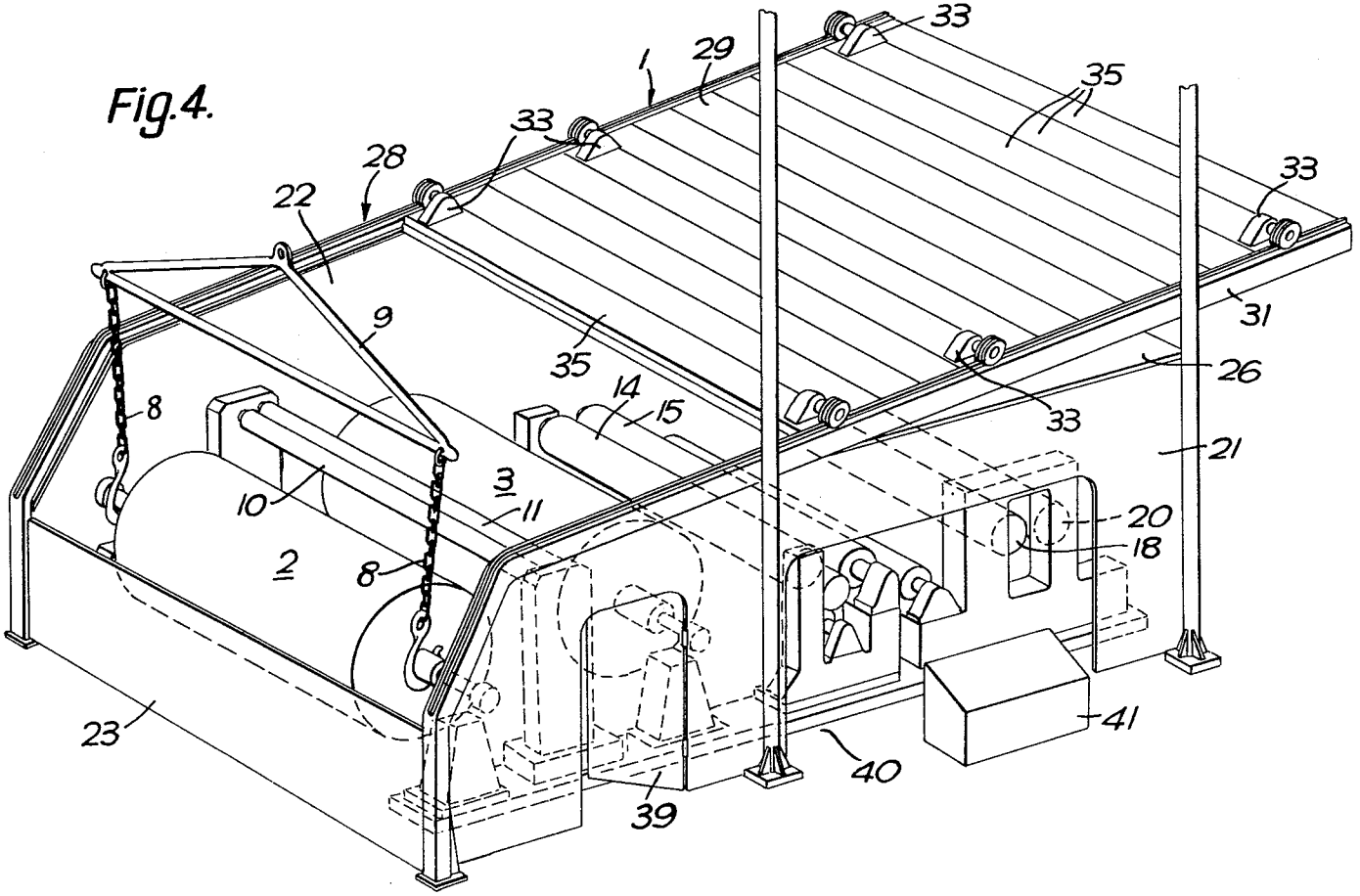
FIG. 4 is a view similar to FIG. 3 showing another form of moveable booth cover.

An alternative form of moveable cover, as shown in FIG. 4, is formed of slats 35 or like elongated elements having their ends riding along the guides longitudinally of the machinery and the booth and articulated to and overlapping or interengaging with the contiguous slats of the cover so as to form in the closed position a dust tight closure over the top of the intake end of the booth.

The guides at the intake end curve downwardly past the reel 2 so that when the cover is opened there is easy access to the reel 2 from the left of FIG. 1, while a door 39 is formed in the side booth on the right of FIG. 2 which is called the front of the machine to allow access for operatives between the reels 2 and 3. There is an open area 40 in the front side wall of the booth against which there is an operator's console 41 where he has the controls for the whole machine as well as for the sliding cover of the booth. Access is possible for the operatives through the open area 40 so that the operatives can get at the rolls 14, 15 and other parts of the machinery in that area. Access to the bars 4 is through the take-off opening.

When it is desired to load the machine the moveable cover is withdrawn by the traction means which is controlled by a winch, 54 (FIG. 1), of standard construction. The winch may be operable to move the traction means in either direction in the form of a closed loop of cable having connecting means 43 to the cover and extending round rollers 43*a* at the intake end or spring or hydraulic means may be provided to return the cover to the closed position.

On the rear side of the machine, i.e. to the left in FIG. 2, are a number of ducts 45 each of which is connected into a main conduit 46 leading to a source of reduced pressure of conventional design which produces reduced pressure at the openings 39, 40 and 24, and in each of the ducts 45 which open at 47 into the interior of the booth adjacent the moving paper tissue sheets, the air flow being controlled to prevent the egress of dust into the atmosphere surrounding the booth. These ducts induce flow of air through the open area and the take-off end as well as through the door 42 across the tissue operating area and the degree of suction created in the ducts is sufficient to ensure a steady flow of air into the booth to prevent the egress of dust from the booth.

In both constructions, the end of the moveable cover which in the closed position is at the bottom of the guides at the intake end, is shaped to engage with the top member 53 of the end wall of the booth to form a dust tight cover thereto.

It can be seen that by means of the invention the machine in operation is enclosed and dust is contained within the booth so that it does not cause a fire hazard or inconvenience to the operators of the machine.

Apart from the extraction of the dust from within the booth, the control of dust movement is to avoid any substantial outflow from the booth into the ambient air where it is a substantial fire hazard and is unpleasant for the operatives who control operations at points outside the booth. Thus the inflow of air into the booth is desirably only sufficient to prevent the outflow into the ambient air and it must not be such as to create within the booth a turbulence which will disturb the unruffled fast moving sheets of material being rewound.

The ducts opening into the booth are subjected to reduced pressure by known means such as a fan which may be associated with the ducts at a point remote from the booth. The fan is driven by a prime mover such as an electric motor and this prime mover is run at a fixed speed to maintain the negative pressure across the booth openings and to extract the suspended dust in the booth while not allowing the rate of air flow which will create any substantial disturbance of the sheets being rewound in the booth. Alternatively dampers or like throttling means may be provided in the ducts or in the main conduit leading from the ducts to the fan, such dampers or throttling means being normally partly closed during rewinding to maintain the air velocity through the vents and openings in the booth at the required level. During rewinding some dust will settle on the floor of the booth; when the rewinding operation is completed the fan prime mover is driven at high speed with the dampers open so that the settled dust is sucked out of the booth by high velocity compressed air. It is however possible for these adjustments of the fan speed and/or operation of the dampers or other means to maintain the air velocity at the required level to be carried out by hand by the machine operator.

The dust is thus mainly contained in the booth and can be removed by any suitable means such as vacuum cleaners when the reels in the booth are being replaced.

I claim:

1. Apparatus for use with paper, tissue and like fibrous sheet material rewind machinery comprising a booth disposable substantially around rewind machinery to form an enclosed compartment therearound, said booth having side walls extending up from a floor on which rewind machinery is disposed, an intake end wall extending up from the floor, a take-off end opening for withdrawal of rewind bars, a fixed cover over at least part of said take-off end, an uncovered top portion at said take-off end through which wound reels may be introduced and withdrawn, vent openings in said booth connected to extraction conduits to create reduced pressure thereat, a moveable cover portion moveable between an inoperative position clear of said intake opening, and an operative position in which it closes said intake opening, means to move said cover between said positions, and means to create pressure difference between the inside and outside of the booth to induce flow of air from the atmosphere through said vent openings to minimise egress of dust from said booth without substantially disturbing said sheet material as it is rewound in said booth.

2. Apparatus according to claim 1 wherein said cover comprises a panel riding along guides in said booth longitudinally of said machinery.

3. Apparatus according to claim 1 wherein said intake opening extends below said cover in the inoperative position, said cover comprises a panel moveable in longitudinal guides on said booth and said panel has an end portion articulated thereto to close said lower portion of said intake opening in said operative position.

4. Apparatus according to claim 1 wherein said moveable cover comprises a series of elongated slat-like elements the ends of which ride along longitudinal guides on said booth, said elements being articulated to and overlapping or interengaging with contiguous slat-like elements.

5. Apparatus according to claim 1 wherein said cover moving means comprises guides along the upper portions of the sides of said booth, guidable members moveable in said guides, and traction means moveable along said guides by power operated means to move said moveable cover between said operable and inoperable positions.

6. Apparatus according to claim 1 wherein ducts are disposed communicating with the interior of said booth out of the path of movement of the shells and said sheet material being wound, and intake apertures into said ducts, said apertures being above, level and/or beneath said shells and said moving sheets, said ducts being operable under reduced pressure to induce the flow of air through said booth vent openings.

* * * * *